US009995191B2

(12) United States Patent
Yuda et al.

(10) Patent No.: US 9,995,191 B2
(45) Date of Patent: Jun. 12, 2018

(54) OIL FEED MEMBER AND LUBRICANT FEED MECHANISM FOR ENGINE PROVIDED WITH SAME

(71) Applicant: TAIHO KOGYO CO., LTD., Toyota-shi, Aichi (JP)

(72) Inventors: Keiji Yuda, Toyota (JP); Yasuhiro Hikita, Toyota (JP); Masahiro Kawahara, Toyota (JP); Satoru Kanbara, Toyota (JP); Syuhei Nishida, Toyota (JP)

(73) Assignee: Taiho Kogyo Co., Ltd., Toyota-shi, Aichi (JP)

( * ) Notice: Subject to any disclaimer, the term of this patent is extended or adjusted under 35 U.S.C. 154(b) by 2 days.

(21) Appl. No.: 15/305,554

(22) PCT Filed: Apr. 28, 2015

(86) PCT No.: PCT/JP2015/062848

§ 371 (c)(1),
(2) Date: Oct. 20, 2016

(87) PCT Pub. No.: WO2015/178180

PCT Pub. Date: Nov. 26, 2015

(65) Prior Publication Data

US 2017/0044940 A1 Feb. 16, 2017

(30) Foreign Application Priority Data

May 21, 2014 (JP) ..... 2014-104836

(51) Int. Cl.
*F01M 9/10* (2006.01)
*F01L 1/12* (2006.01)
(Continued)

(52) U.S. Cl.
CPC ..... *F01M 9/10* (2013.01); *F01L 1/053* (2013.01); *F01L 1/12* (2013.01); *F02F 1/24* (2013.01);
(Continued)

(58) Field of Classification Search
CPC . F01M 9/10; F01M 1/08; F01M 11/02; F01M 9/102; F01M 1/06; F01L 1/12; F02F 1/24
See application file for complete search history.

(56) References Cited

U.S. PATENT DOCUMENTS

2010/0095922 A1* 4/2010 Nakajima ..... F01M 13/0416 123/196 A
2014/0076266 A1* 3/2014 Honnikoppa ..... F01M 1/08 123/196 R
2015/0260062 A1 9/2015 Hikita et al.

FOREIGN PATENT DOCUMENTS

DE 35 20 876 C1 9/1986
JP 2008-38846 A 2/2008
WO WO 2014/050716 A1 4/2014

OTHER PUBLICATIONS

International Search Report (PCT/ISA/210) dated Jul. 28, 2015, by the Japanese Patent Office as the International Searching Authority for International Application No. PCT/JP2015/062848.
(Continued)

*Primary Examiner* — Jacob Amick
(74) *Attorney, Agent, or Firm* — Buchanan Ingersoll & Rooney PC

(57) ABSTRACT

There is provided an oil feed member capable of preventing lubricant from being excessively fed from an oil feed member to lubrication portions of valve gears, and a lubricant feed mechanism for an engine provided with the same. An oil feed member for feeding lubricant to lubrication portions of valve gears for opening and closing intake valves and exhaust valves of an engine, the oil feed member
(Continued)

including: an upper panel member and a lower panel member laid over each other; and an oil feed passage formed by recessing laid surfaces of the upper panel member and the lower panel member, wherein the oil feed passage includes basis oil passages formed on a downstream side, and an introduction oil passage formed on an upstream side and having a smaller lubricant flow area than that of the basis oil passages.

19 Claims, 9 Drawing Sheets

(51) Int. Cl.

| | |
|---|---|
| ***F02F 1/24*** | (2006.01) |
| ***F01L 1/053*** | (2006.01) |
| *F01L 1/18* | (2006.01) |
| *F01L 1/24* | (2006.01) |

(52) U.S. Cl.
CPC ..... *F01L 1/185* (2013.01); *F01L 1/2405* (2013.01); *F01L 2001/0537* (2013.01); *F01L 2101/00* (2013.01); *F01L 2105/00* (2013.01); *F01L 2810/02* (2013.01)

(56) References Cited

OTHER PUBLICATIONS

Written Opinion (PCT/ISA/237) dated Jul. 28, 2015, by the Japanese Patent Office as the International Searching Authority for International Application No. PCT/JP2015/062848.

* cited by examiner

OIL FEED MEMBER AND LUBRICANT FEED MECHANISM FOR ENGINE PROVIDED WITH SAME

TECHNICAL FIELD

The present invention relates to techniques of an oil feed member for feeding lubricant to lubrication portions of valve gears for opening and closing intake and exhaust valves of an engine, and a lubricant feed mechanism for an engine provided with the same.

BACKGROUND ART

Conventionally, there have been publicly known techniques of an oil feed member for feeding lubricant to lubrication portions of valve gears for opening and closing intake and exhaust valves of an engine, and a lubricant feed mechanism for an engine provided with the same, as described in, for example, Patent Literature 1.

Patent Literature 1 describes an oil feed member (shower pipe) mounted on a cylinder cover of a cylinder head of an engine. The oil feed member is provided with an oil feed port for receiving lubricant to be fed to the oil feed port, and a plurality of discharge ports for discharging lubricant. To the oil feed member, lubricant guided by an oil passage such as an oil gallery of the cylinder head is fed.

In such a configuration, the lubricant fed from the oil passage such as the oil gallery through the oil feed port is discharged from the oil feed member through the plurality of discharge ports, so that the lubricant can be fed to lubrication portions (cams of camshaft) of valve gears disposed below the oil feed member.

However, in the technique described in Patent Literature 1, when the lubricant is fed to the oil feed member by the oil passage such as the oil gallery of the cylinder head, the closer to the oil feed port the discharge port is, more excessively the lubricant is fed. That is, there is a disadvantage that the lubricant is excessively fed from the oil feed member to the lubrication portions of the valve gears.

CITATION LIST

Patent Literature

Patent Literature 1: JP 2008-38846 A

SUMMARY OF INVENTION

Technical Problem

The present invention has been made in view of the above circumstances, and the problem to be solved is to provide an oil feed member capable of preventing lubricant from being excessively fed from an oil feed member to lubrication portions of valve gears, and a lubricant feed mechanism for an engine provided with the same.

Solution to Problem

The problem to be solved by the present invention is described above, and solutions for solving this problem are described as follows.

An oil feed member of the present invention is an oil feed member for feeding lubricant to lubrication portions of valve gears for opening and closing intake and exhaust valves of an engine, the oil feed member including: a pair of panel members laid over each other; and an oil passage formed by recessing laid surfaces of the pair of panel members, wherein the oil passage includes a downstream oil passage formed on a downstream side, and an upstream oil passage formed on an upstream side and having a smaller lubricant flow area than that of the downstream oil passage.

In the oil feed member of the present invention, the upstream oil passage includes a bent part that is bent to give pressure loss to the lubricant.

In the oil feed member of the present invention, the bent part includes an acute angle bent part that is bent at an acute angle.

In the oil feed member of the present invention, the oil feed member further includes: an oil feed port formed in an upstream end portion of the oil passage, for receiving the lubricant to be fed to the oil passage; a plurality of discharge ports for discharging the lubricant to the lubrication portions from above, the plurality of discharge ports being formed in downstream end portions of the oil passage; a plurality of derived oil passages for guiding, to the respective plurality of discharge ports, the lubricant from the downstream oil passage, the plurality of derived oil passages being branched from the downstream oil passage, wherein the plurality of derived oil passages are formed such that a derived oil passage having a shorter lubricant circulation channel from the oil feed port to a derived part has a longer lubricant circulation channel in the derived oil passage.

In the oil feed member of the present invention, the plurality of derived oil passages have a smaller lubricant flow area than a lubricant flow area of the downstream oil passage.

The oil feed member of the present invention is mounted on a head cover of a cylinder head of the engine, and doubles as a baffle plate for partitioning an oil separator chamber for separating oil from blow-by gas.

In the oil feed member of the present invention, the downstream oil passage, the plurality of derived oil passages, and the plurality of discharge ports are provided on each of the intake valve side and the exhaust valve side.

In the oil feed member of the present invention, the oil passage includes distribution oil passages for distributing and guiding, to the respective downstream oil passages on each of the intake valve side and the exhaust valve side, the lubricant from the upstream oil passage.

In the oil feed member of the present invention, the pair of panel members are formed of resin.

A lubricant feed mechanism for an engine of the present invention includes the oil feed member according to any one of claims 1 to 9.

Advantageous Effects of Invention

As advantageous effects of the present invention, the following advantageous effects are exerted.

In the oil feed member of the present invention, the lubricant can be prevented from being excessively fed from the oil feed member to the lubrication portions of the valve gears.

In the oil feed member of the present invention, it is possible to equalize the amounts of the lubricant discharged from the plurality of discharge ports.

In the oil feed member of the present invention, it is possible to reduce the number of components.

In the oil feed member of the present invention, it is possible to feed the lubricant to the lubrication portions on the intake valve and the exhaust valve with a simple configuration.

In the oil feed member of the present invention, it is possible to reduce weight.

In the lubricant feed mechanism for an engine of the present invention, the lubricant can be prevented from being excessively fed from the oil feed member to the lubrication portions of the valve gears.

DESCRIPTION OF EMBODIMENTS

Figure 1:
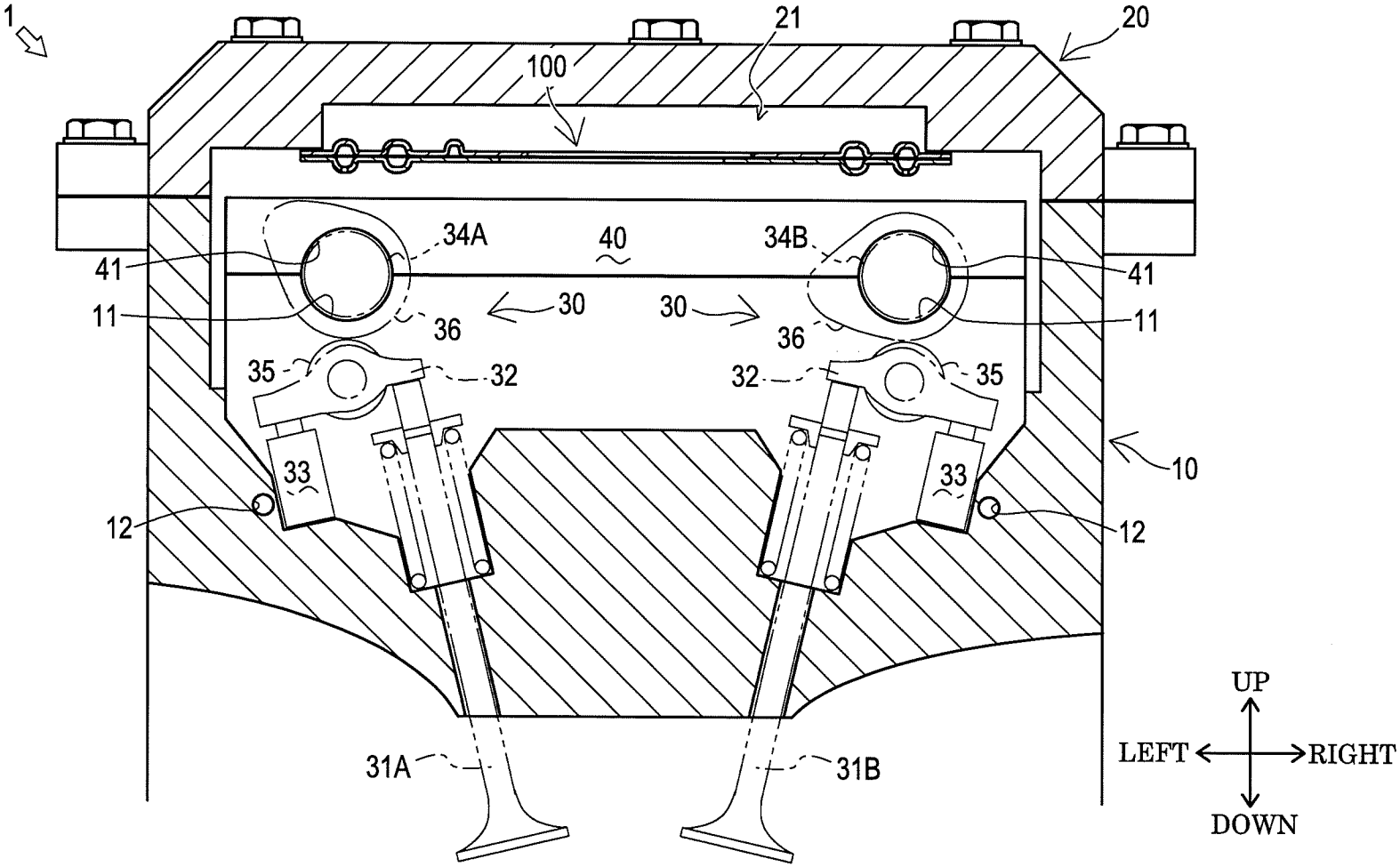
FIG. 1 is a cross-sectional view of the inside of a cylinder head cover of an engine according to an embodiment of the present invention.

Hereinafter, the up-down direction, the right-left direction, and the front-back direction are defined in accordance with the arrows illustrated in the drawings.

First, a configuration of an engine 1 provided with a lubricant feed mechanism according to an embodiment of the present invention will be described with reference to FIG. 1.

The engine 1 according to this embodiment is an inline 4-cylinder double overhead camshaft (DOHC) 16-valve gasoline engine. In the engine 1, a structure of an intake side and a structure of an exhaust side are substantially the same. In the following, for convenience of description, the structure of the exhaust side (structure of the left illustrated in FIG. 1) will be mainly described, and description of the structure of the intake side (structure of the right illustrated in FIG. 1) will be appropriately omitted.

The engine 1 mainly includes a cylinder head 10, a cylinder head cover 20, valve gear 30, a cam cap 40, and an oil feed member 100.

The cylinder head 10 serves as a main structural body of the engine 1 together with a cylinder block (not illustrated). The cylinder head 10 is fixed to an upper surface of the cylinder block. The cylinder head 10 mainly includes cylinder-head-side bearings 11 and an oil gallery 12.

The cylinder-head-side bearings 11 rotatably support an exhaust-side camshaft 34A, which will be described later, from below. The cylinder-head-side bearings 11 are each formed on the left part of the cylinder head 10 so as to be recessed in a semicircular shape with the upper side open in front view.

The oil gallery 12 is an oil passage for feeding lubricant to respective parts of the engine 1 (for example, lubrication portions of the engine 1, and hydraulic apparatuses such as lash adjusters 33 described later). The oil gallery 12 is formed so as to pass through a left sidewall of the cylinder head 10 in the front-back direction.

The cylinder head cover 20 covers an upper part of the cylinder head 10. The cylinder head cover 20 is formed in a cup shape with the lower side open. The cylinder head cover 20 is placed on the upper part of the cylinder head 10, and appropriately fixed by bolts or the like. Inside the cylinder head cover 20, a baffle plate (oil feed member 100 described later in this embodiment) is mounted, and an oil separator chamber 21 is partitioned. The oil separator chamber 21 can accumulate blow-by gas, and enables the blow-by gas to flow back to an intake system after oil dropping is performed.

The valve gear 30 is a component for opening and closing an exhaust port (not illustrated) of the engine 1 at predetermined timing. The valve gear 30 mainly includes exhaust valves 31A, rocker arms 32, the lash adjusters 33, and the exhaust-side camshaft 34A.

Each of the exhaust valves 31A opens and closes the exhaust port (not illustrated) of the engine 1. The exhaust valve 31A is disposed such that the longitudinal direction is directed to the substantially up-down direction. A lower end of the exhaust valve 31A extends up to the exhaust port. A middle portion in the up-down direction of the exhaust valve 31A is slidably inserted into the cylinder head 10.

Each of the rocker arms 32 is a component for openably driving the exhaust valve 31A. One end of the rocker arm 32 abuts on an upper end of the exhaust valve 31A from above. The rocker arm 32 is provided with a rotatable roller 35 with an axis in the front-back direction as the center.

Each of the lash adjusters 33 is a component for adjusting a valve clearance. The lash adjuster 33 abuts on the other end of the rocker arm 32 from below.

Although illustration is omitted, two exhaust valves 31A are provided for one cylinder so as to be arranged in the front-back direction. That is, in this embodiment, a total of eight exhaust valves 31A are provided. Additionally, a total of eight rocker arms 32, a total of eight rollers 35, and a total of eight lash adjusters 33 are provided so as to correspond to the total of the eight exhaust valves 31A.

The exhaust-side camshaft 34A is a component for openably driving the exhaust valves 31A by rocking the rocker arms 32 at predetermined timing. The exhaust-side camshaft 34A is placed on the cylinder-head-side bearings 11 of the cylinder head 10 in a state where the longitudinal direction is directed to the front-back direction. The exhaust-side camshaft 34A mainly includes the cams 36.

Each of the cams 36 is a part formed in a plate shape in which a distance from the rotation center (center of the exhaust-side camshaft 34A) to an outer periphery is not constant. The cam 36 is disposed at a position corresponding to each cylinder in the front-back direction. The cam 36 abuts on the roller 35 of the rocker arm 32 from above. In this embodiment, a total of eight cams 36 are provided, and abut on the respective corresponding rollers 35 from above.

The cam cap 40 is a component that is fixed to the upper part of the cylinder head 10, and holds the exhaust-side camshaft 34A between the cam cap 40 and the cylinder head 10. The cam cap 40 is formed in a substantially rectangular parallelpiped shape in which the longitudinal direction is directed to the right-left direction. The cam cap 40 mainly includes cam-cap-side bearings 41.

The cam-cap-side bearings 41 rotatably support the exhaust-side camshaft 34A from above. The cam-cap-side bearings 41 are each formed on the left part of the cam cap 40 so as to be recessed in a semicircular shape with the lower side open in front view. The cam-cap-side bearing 41 is formed at such a position as to face the cylinder-head-side bearing 11 of the cylinder head 10, and rotatably supports the exhaust-side camshaft 34A together with the cylinder-head-side bearing 11.

The oil feed member 100 is a member for feeding, to predetermined lubrication portions (cams 36 of the exhaust-side camshaft 34A in this embodiment), lubricant fed from the oil gallery 12 through a predetermined oil passage. The oil feed member 100 is mounted on the inside of the cylinder head cover 20.

A configuration of the oil feed member 100 will be later described in detail.

Although specific description is omitted, the engine 1 having the above configuration includes a valve gear 30 (on the intake side) for opening and closing an intake port (not illustrated) of the engine 1 at predetermined timing, as the structure of the intake side (structure of the right illustrated in FIG. 1). The valve gear 30 on the intake side mainly includes intake valves 31B, rocker arms 32, lash adjusters 33, and an intake-side camshaft 34B similarly to the valve gear 30 on the exhaust side, as illustrated in FIG. 1.

Hereinafter, the configuration of the oil feed member 100 will be described with reference to FIG. 1 to FIG. 8.

The oil feed member 100 illustrated in FIG. 1 to FIG. 8 is formed in an elongated flat plate shape. The oil feed member 100 is mounted inside the cylinder head cover 20. The oil feed member 100 is disposed such that the longitudinal direction is the front-back direction, and the plate surface is directed to the up-down direction. As illustrated in FIG. 1, the oil feed member 100 is disposed to face the exhaust-side camshaft 34A and the intake-side camshaft 34B in the up-down direction.

As illustrated in FIG. 1, the oil feed member 100 partitions a predetermined space (oil separator chamber 21) between the oil feed member 100 and an upper wall, inside the cylinder head cover 20. Thus, the oil feed member 100 has a function of feeding lubricant to the cams 36 of the exhaust-side camshaft 34A, and has a function as a baffle plate for partitioning the oil separator chamber 21 (doubles as a baffle plate). With such a configuration, it is possible to reduce the number of components in an upper space of each valve gear 30 where a location space for the components is relatively small.

Figure 2:
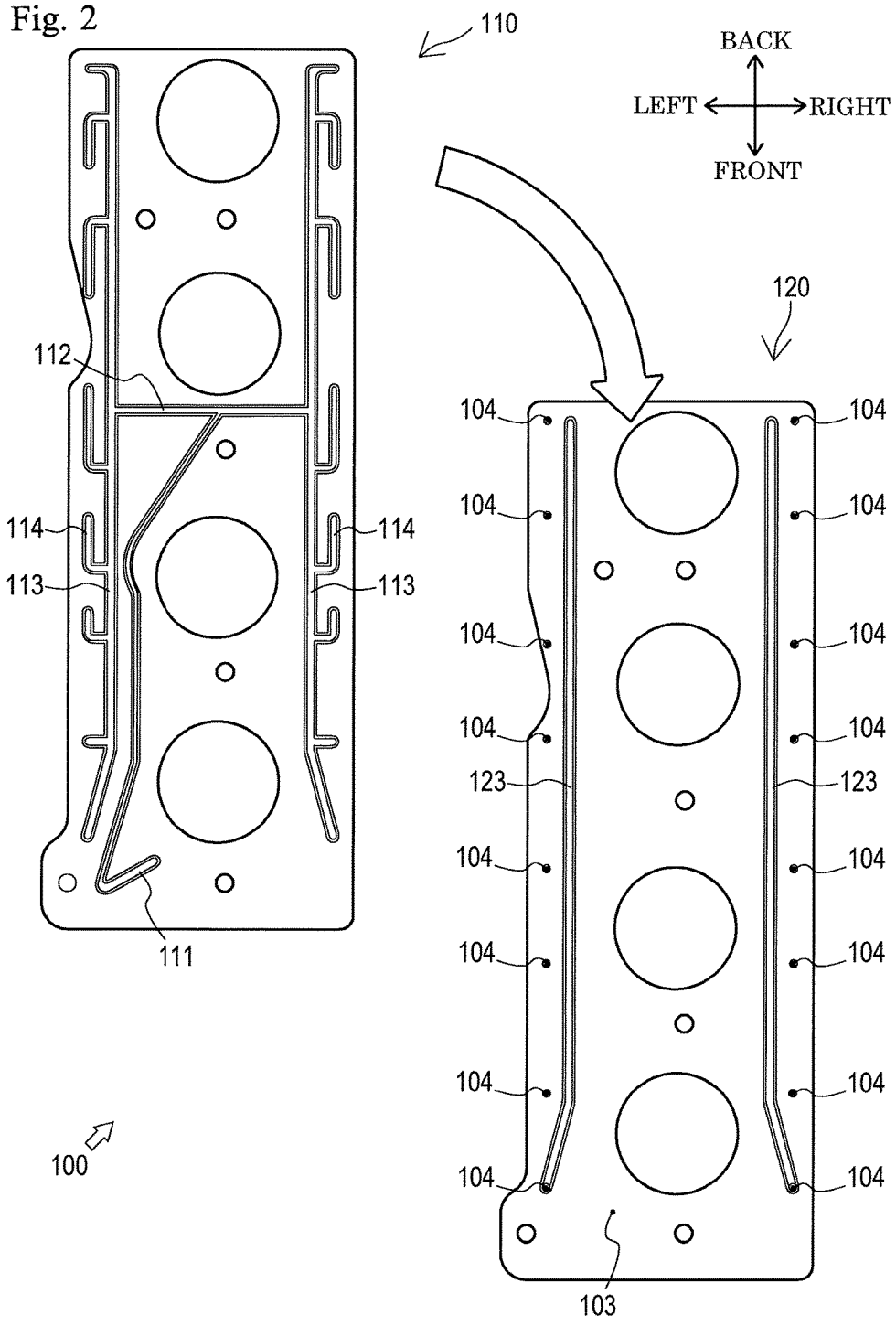
FIG. 2 is a plan view illustrating an upper panel member and a lower panel member of an oil feed member.

As illustrated in FIG. 2, a pair of panel members (specifically, an upper panel member 110 and a lower panel member 120) are vertically laid over each other (stuck to each other), so that the oil feed member 100 is formed. The upper panel member 110 and the lower panel member 120 are appropriately caulked or welded to be held in a state of abutting on each other. In each of laid (inner) surfaces of the upper panel member 110 and the lower panel member 120, an elongated recess (specifically, upper introduction recess 111, described later, and the like) recessed outward is formed. The upper panel member 110 and the lower panel member 120 abut on each other, so that the above recesses are configured as an oil passage enabling lubricant to circulate.

The oil feed member 100 mainly includes openings 101, an oil feed passage 102, an oil feed port 103, and discharge ports 104.

Figure 3:
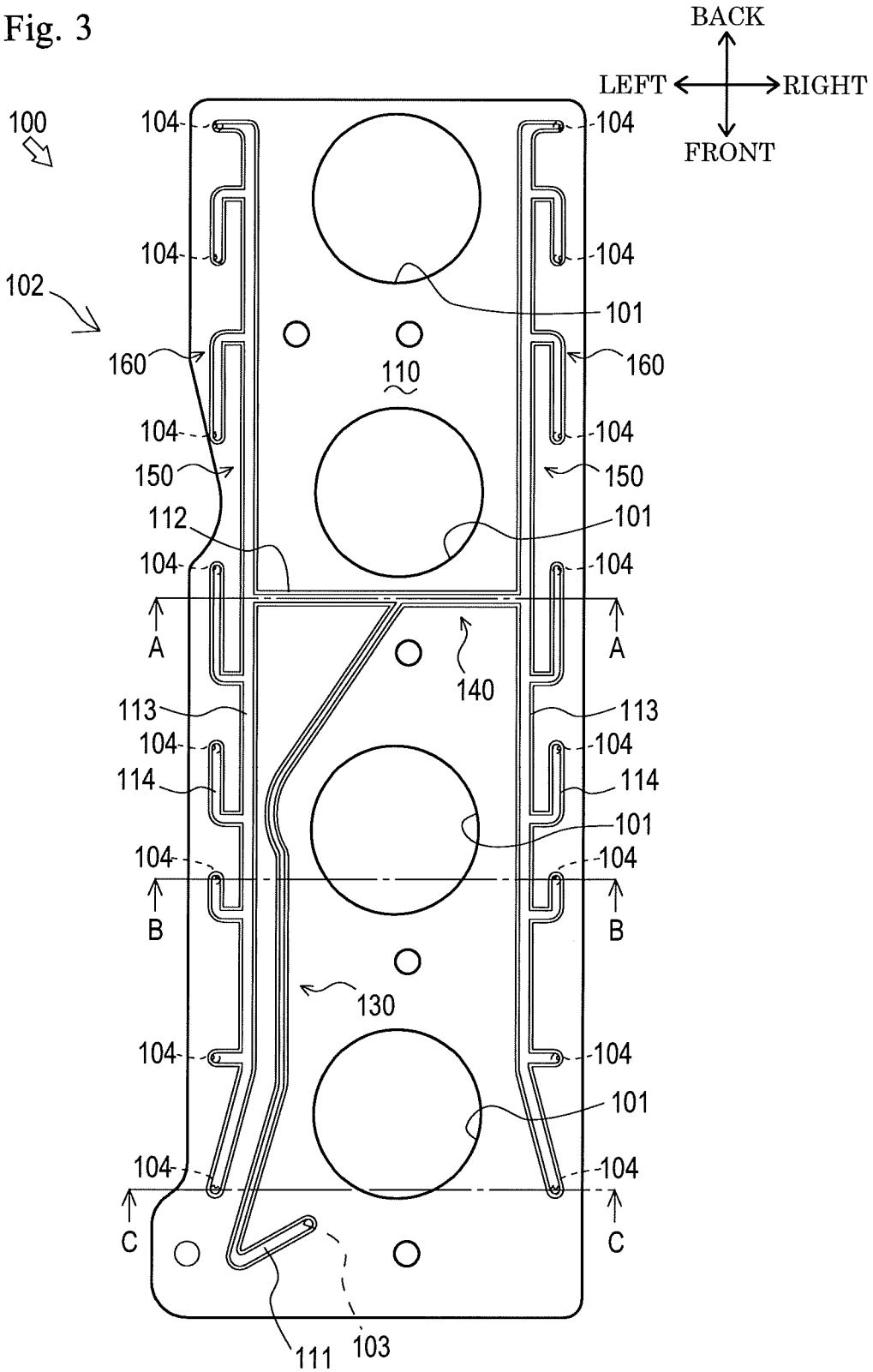
FIG. 3 is a plan view illustrating the oil feed member.
Figure 4:
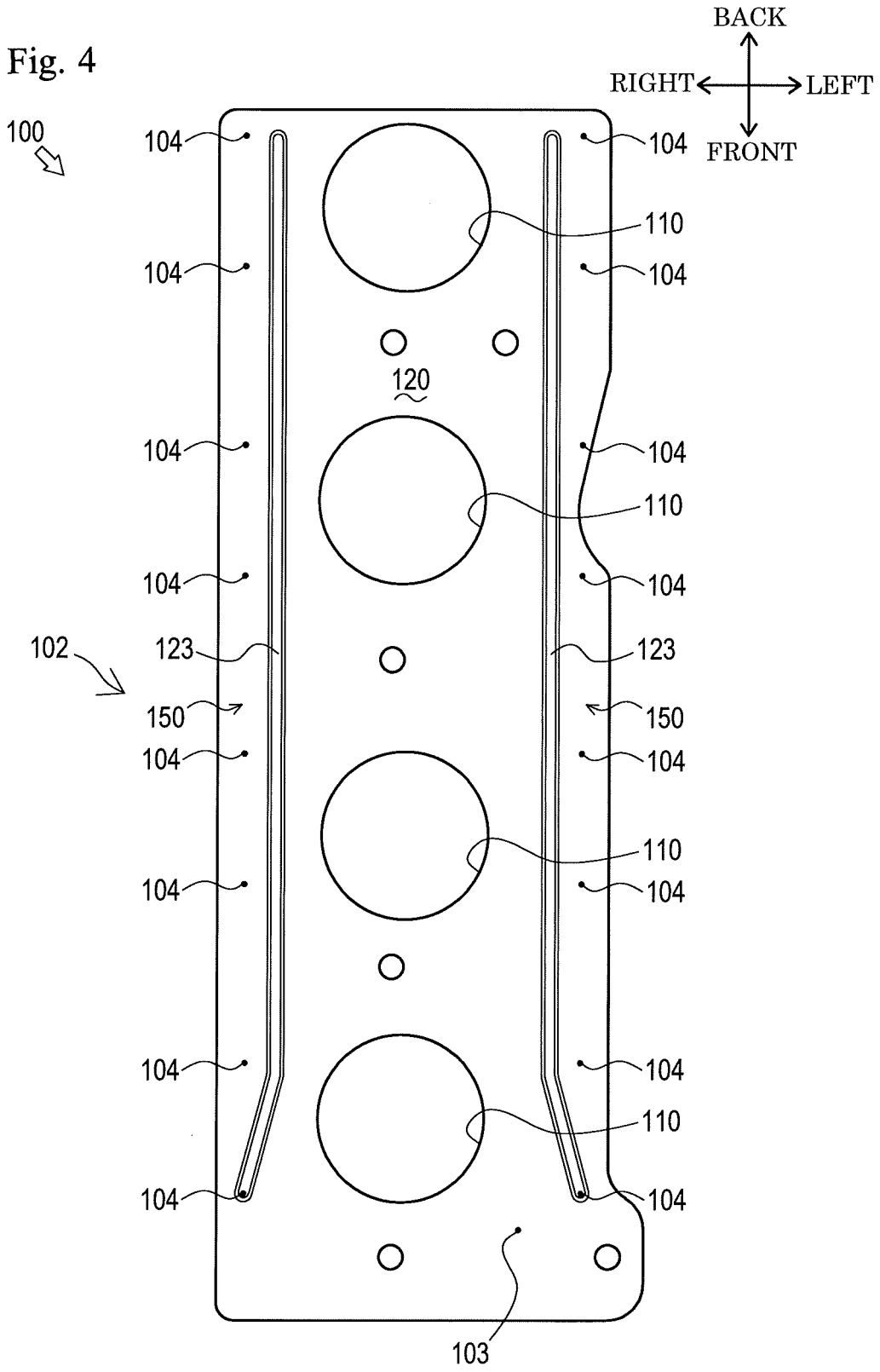
FIG. 4 is a bottom view of the oil feed member.

The openings 101 illustrated in FIG. 3 and FIG. 4 are holes for allowing an ignition plug (not illustrated) to pass. The openings 101 pass through the oil feed member 100 (the upper panel member 110 and the lower panel member 120) in the up-down direction. The openings 101 are each formed in a substantial circle in plan view. A plurality (four in this embodiment) of the openings 101 are provided. The four openings 101 are disposed at appropriate intervals in the front-back direction at a substantially central part in the right-left direction of the oil feed member 100.

The oil feed passage 102 illustrated in FIG. 3 to FIG. 8 is a passage for guiding, to the discharge ports 104, lubricant fed to the oil feed port 103 of the oil feed member 100. The oil feed passage 102 includes an introduction oil passage 130, a distribution oil passage 140, basis oil passages 150, and derived oil passages 160.

Figure 5A:
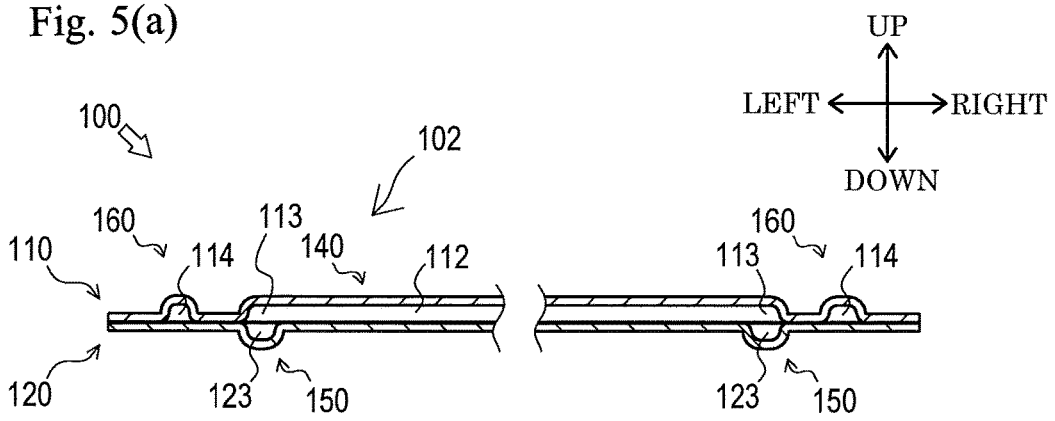
FIG. 5(*a*) is a cross-sectional view taken along line A-A in FIG. 3, FIG. 5 (*b*) is a cross-sectional view taken along line B-B in FIG. 3, and FIG. 5 (*c*) is a cross-sectional view taken along line C-C in FIG. 3.
Figure 5B:
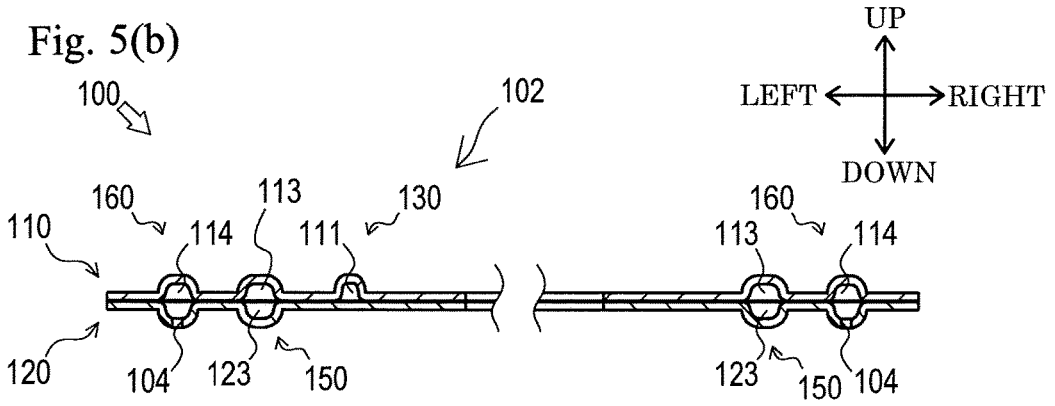
Figure 5C:
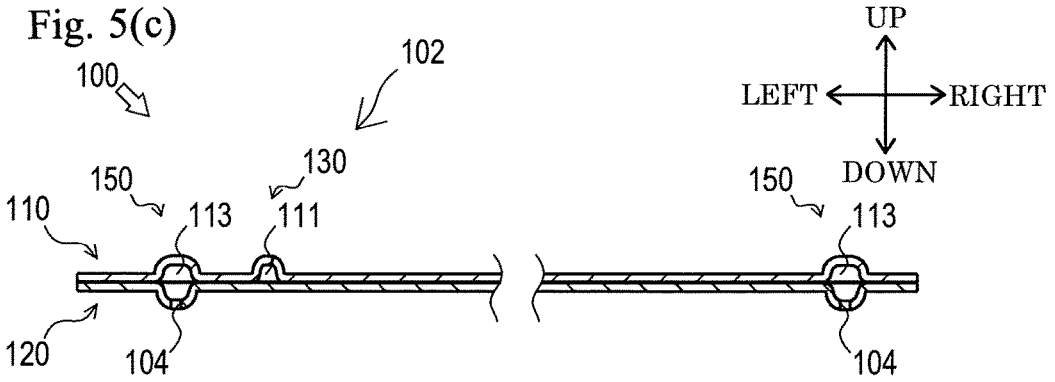

The introduction oil passages 130 each are an oil passage formed on the most upstream side in the oil feed passage 102. As illustrated in FIG. 3, FIG. 4, and FIG. 5(*b*), the introduction oil passage 130 is formed by the upper introduction recess 111 formed in the upper panel member 110, and an upper surface of the lower panel member 120. The upper introduction recess 111 is an elongated recess formed recessing a lower surface of the upper panel member 110 outward (upward). Thus, the upper introduction recess 111 and the upper surface of the lower panel member 120 abut on each other, so that the introduction oil passage 130 is formed. The introduction oil passage 130 introduces (guides), to the inside (distribution oil passage 140), lubricant fed to the oil feed member 100.

The flow area of the introduction oil passage 130 is formed so as to be substantially the same as the flow area of the distribution oil passage 140 and the derived oil passages 160, which will be described later. Additionally, the flow area of the introduction oil passage 130 is formed so as to be smaller than the flow area of the basis oil passages 150 described later as illustrated in FIG. 5(*b*). Herein, the "flow area" means the area (size of an oil hole) of the inside of the oil passage orthogonal to the circulating direction of lubricant.

The introduction oil passage 130 is disposed at a left front part of the oil feed member 100 such that the longitudinal direction is generally directed to the front-back direction. A front end of the introduction oil passage 130 is disposed in the vicinity of a left front end of the oil feed member 100. A back end of the introduction oil passage 130 is disposed at a substantially central part of the oil feed member 100.

The distribution oil passage 140 is an oil passage formed on a downstream side with respect to the introduction oil passage 130 in the oil feed passage 102. As illustrated in FIG. 3, FIG. 4, and FIG. 5(*a*), the distribution oil passage 140 is formed by an upper distribution recess 112 formed in the upper panel member 110, and the upper surface of the lower panel member 120. The upper distribution recess 112 is an elongated recess formed by recessing the lower surface of the upper panel member 110 outward (upward). Thus, the upper distribution recess 112 and the upper surface of the lower panel member 120 abut on each other, so that the distribution oil passage 140 is formed. The distribution oil passage 140 distributes lubricant fed from the introduction oil passage 130, into the basis oil passage 150 on the left (exhaust valve 31A side) and the basis oil passage 150 on the right (intake valve 31B side) to guide to the basis oil passage 150 on the left (exhaust valve 31A side) and the basis oil passage 150 on the right (intake valve 31B side).

The distribution oil passage 140 is disposed at a substantially central part in the front-back direction of the oil feed member 100 such that the longitudinal direction is directed to the right-left direction. A left end of the distribution oil passage 140 is disposed in the vicinity of a left end of the oil feed member 100. A right end of the distribution oil passage 140 is disposed in the vicinity of a right end of the oil feed member 100. A substantially central part in the longitudinal direction of the distribution oil passage 140 is connected to the back end of the introduction oil passage 130. Thus, the distribution oil passage 140 communicates with the introduction oil passage 130.

The basis oil passages 150 each are an oil passage formed on a downstream side with respect to the distribution oil passage 140 in the oil feed passage 102. The respective basis oil passages 150 are formed on the left (exhaust valve 31A side) and the right (intake valve 31B side) of the oil feed member 100. Herein, the configurations of the right and left basis oil passages 150 are substantially symmetric in the right-left direction, as illustrated in FIG. 3 and FIG. 4. Therefore, the configuration of the left basis oil passage 150 in the right and left basis oil passages 150 will be described in the following description, and description of the configuration of the right basis oil passage 150 will be appropriately omitted.

The configurations of the right and left basis oil passages 150 are substantially symmetric in the right-left direction in this embodiment, but may be asymmetrical in the right-left direction.

As illustrated in FIG. 3, FIG. 4, and FIG. 5(*b*), the basis oil passage 150 is formed by an upper basis recess 113 formed in the upper panel member 110, and a lower basis recess 123 formed in the lower panel member 120. The upper basis recess 113 is an elongated recess formed by recessing the lower surface of the upper panel member 110 outward (upward). The lower basis recess 123 is an elongated recess formed by recessing the upper surface of the lower panel member 120 outward (downward). The upper basis recess 113 and the lower basis recess 123 have the same shape and the same size so as to overlap with each other in plan view. Thus, the upper basis recess 113 and the lower basis recess 123 abut on each other, so that the basis oil passage 150 is formed. The basis oil passage 150 guides (distributes), to the derived oil passages 160, lubricant fed from the distribution oil passage 140.

The basis oil passage 150 is disposed in the vicinity of the left end of the oil feed member 100 such that the longitudinal direction is directed to the right-left direction. A front end of the basis oil passage 150 is disposed in the vicinity of a front end of the oil feed member 100. A back end of the basis oil passage 150 is disposed in the vicinity of a back end of the oil feed member 100. A part slightly behind from a central part in the longitudinal direction of the basis oil passage 150 is connected to the left end of the distribution oil passage 140. Thus, the basis oil passage 150 communicates with the introduction oil passage 130.

The derived oil passages 160 each are an oil passage formed on a downstream side (most downstream side) with respect to the basis oil passage 150 in the oil feed passage 102. Similarly to the basis oil passage 150, the derived oil passages 160 are formed on the left (exhaust valve 31A side) and the right (intake valve 31B side) of the oil feed member 100. Herein, the configurations of the right and left derived oil passages 160 are substantially symmetric in the right-left direction, as illustrated in FIG. 3 and FIG. 4. Therefore, the configuration of the left derived oil passage 160 in the right and left derived oil passages 160 will be described in the following description, and description of the configuration of the right derived oil passage 160 will be appropriately omitted.

The configurations of the right and left derived oil passages 160 are substantially symmetric in the right-left direction in this embodiment, but may be asymmetrical in the right-left direction.

As illustrated in FIG. 3, FIG. 4, and FIG. 5(*a*), the derived oil passages 160 are formed by upper derived recesses 114 formed in the upper panel member 110, and the upper surface of the lower panel member 120. The upper derived recesses 114 each are an elongated recess formed by recessing the lower surface of the upper panel member 110 outward (upward). Thus, the upper derived recesses 114 and the upper surface of the lower panel member 120 abut on each other, so that the derived oil passages 160 are formed. The derived oil passages 160 guide, to the discharge ports 104 described later, lubricant fed from the basis oil passage 150.

A plurality of (seven in this embodiment) the derived oil passages 160 are provided so as to be branched from the basis oil passage 150. Hereinafter, the seven derived oil passages 160 are referred to as a first derived oil passage 161, a second derived oil passage 162, a third derived oil passage 163, a fourth derived oil passage 164, a fifth derived oil passage 165, sixth derived oil passage 166, and a seventh derived oil passage 167 in order from the back side.

Figure 8:
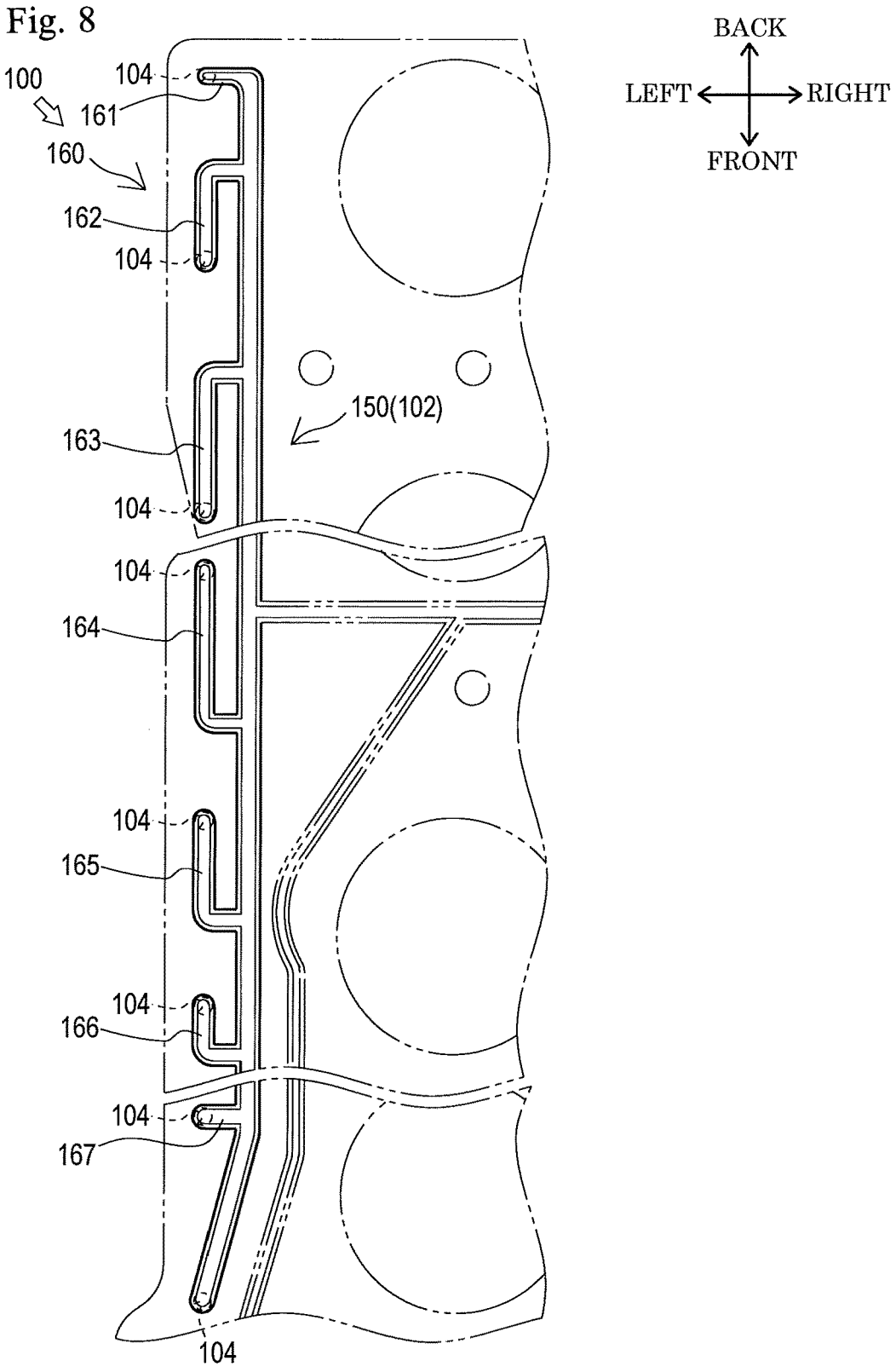
FIG. 8 is a plan view illustrating a basis oil passage and derived oil passages.

The first derived oil passage 161 illustrated in FIG. 8 has a right end connected to the back end of the basis oil passage 150. A left end of the first derived oil passage 161 extends leftward. Thus, the first derived oil passage 161 is formed in a substantially straight line in plan view. The first derived oil passage 161 communicates with the basis oil passage 150.

The second derived oil passage 162 illustrated in FIG. 8 is disposed on the front side with respect to the first derived oil passage 161. A right end of the second derived oil passage 162 is connected to the vicinity of the back end of the basis oil passage 150 (front side with respect to a connection part of the first derived oil passage 161 and the basis oil passage 150). A left end of the second derived oil passage 162 extends leftward, and thereafter extends forward. Thus, the second derived oil passage 162 is formed in a substantially L-shape in plan view. The second derived oil passage 162 is formed so as to be longer than the first derived oil passage 161. The second derived oil passage 162 communicates with the basis oil passage 150.

The third derived oil passage 163 illustrated in FIG. 8 is disposed on the front side with respect to the second derived oil passage 162. A right end of the third derived oil passage 163 is connected to a back part of the basis oil passage 150 (front side with respect to a connection part of the second derived oil passage 162 and the basis oil passage 150). A left end of the third derived oil passage 163 extends leftward, and thereafter extends forward. Thus, the third derived oil passage 163 is formed in a substantially L-shape in plan view. The third derived oil passage 163 is formed so as to be longer than the second derived oil passage 162. The third derived oil passage 163 communicates with the basis oil passage 150.

The fourth derived oil passage 164 illustrated in FIG. 8 is disposed on the front side with respect to the third derived oil passage 163. A right end of the fourth derived oil passage 164 is connected to a substantially central part in the front-back direction of the basis oil passages 150 (front side with respect to a connection part of the third derived oil passage 163 and the basis oil passage 150). A left end of the fourth derived oil passage 164 extends leftward, and thereafter extends backward. Thus, the fourth derived oil passage 164 is formed in a substantially L-shape in plan view. The fourth derived oil passage 164 is formed so as to be longer than the fifth derived oil passage 165 described later. The fourth derived oil passage 164 communicates with the basis oil passage 150.

The fifth derived oil passage 165 illustrated in FIG. 8 is disposed on the front side with respect to the fourth derived oil passage 164. A right end of the fifth derived oil passage 165 is connected to the vicinity of a central part in the front-back direction of the basis oil passages 150 (front side with respect to a connection part of the fourth derived oil passage 164 and the basis oil passage 150). A left end of the fifth derived oil passage 165 extends leftward, and thereafter extends backward. Thus, the fifth derived oil passage 165 is formed in a substantially L-shape in plan view. The fifth derived oil passage 165 is formed so as to be longer than the sixth derived oil passage 166 described later. The fifth derived oil passage 165 communicates with the basis oil passage 150.

The sixth derived oil passage 166 illustrated in FIG. 8 is disposed on the front side with respect to the fifth derived oil passage 165. A right end of the sixth derived oil passage 166 is connected to a front part of the basis oil passage 150 (front side with respect to a connection part of the fifth derived oil passage 165 and the basis oil passage 150). A left end of the sixth derived oil passage 166 extends leftward, and thereafter extends backward. Thus, the sixth derived oil passage 166 is formed in a substantially L-shape in plan view. The sixth derived oil passage 166 is formed so as to be longer than the seventh derived oil passage 167 described later. The sixth derived oil passage 166 communicates with the basis oil passage 150.

The seventh derived oil passage 167 illustrated in FIG. 8 is disposed on the front side with respect to the sixth derived oil passage 166. A right end of the seventh derived oil passage 167 is connected to a front part of the basis oil passage 150 (front side with respect to a connection part of the sixth derived oil passage 166 and the basis oil passage 150). A left end of the seventh derived oil passage 167 extends leftward. Thus, the seventh derived oil passage 167 is formed in a substantially straight line in plan view. The seventh derived oil passage 167 communicates with the basis oil passage 150.

The oil feed port 103 illustrated in FIG. 2 to FIG. 4, and FIG. 7 is a hole for allowing lubricant to be fed from the outside of the oil feed member 100 to the oil feed passage 102 inside the oil feed member 100. The oil feed port 103 passes through the lower panel member 120 in the up-down direction so as to have a substantially circular shape. The oil feed port 103 is formed at such a position as to overlap with the front end of the introduction oil passage 130 (i.e., upstream end portion of the oil feed passage 102) in plan view. The oil feed port 103 communicates with the oil gallery 12 through a predetermined oil passage. Thus, the oil feed port 103 can guide, to the oil feed passage 102 (more specifically, introduction oil passage 130), lubricant from the oil gallery 12.

The discharge ports 104 illustrated in FIG. 2 to FIG. 6, and FIG. 8 each are a hole for feeding (discharging) lubricant from above to the cam 36 of the exhaust-side camshaft 34A serving as the lubrication portion of the valve gear 30. As illustrated in FIG. 5(*a*) to FIG. 5(*c*), each discharge port 104 passes through a recess, which is formed by recessing the lower panel member 120 outward (downward), in the up-down direction so as to have a substantially circular shape in plan view. A plurality of (eight in this embodiment) the discharge ports 104 are provided on the left (exhaust valve 31A side) of the oil feed member 100.

As illustrated in FIG. 3 and FIG. 8, the seven discharge ports 104 in the eight discharge ports 104 are formed at such positions as to overlap with the left ends of the derived oil passages 160 (the first derived oil passage 161, the second derived oil passage 162, the third derived oil passage 163, the fourth derived oil passage 164, the fifth derived oil passage 165, the sixth derived oil passage 166, and the seventh derived oil passage 167) in plan view. Thus, lubricant guided to the first derived oil passage 161, the second derived oil passage 162, the third derived oil passage 163, the fourth derived oil passage 164, the fifth derived oil passage 165, the sixth derived oil passage 166, and the seventh derived oil passage 167 is discharged from the discharge ports 104 to the outside (downward) of the oil feed member 100 at the respected left ends. Thus, the left ends of the derived oil passages 160 become downstream end portions of the oil feed passage 102.

A remaining discharge port 104 in the eight discharge ports 104 is formed at such a position as to overlap with the front end of the basis oil passage 150 in plan view. Thus, lubricant guided to the front side of the basis oil passages 150 is discharged from the discharge port 104 to the outside (downward) of the oil feed member 100 at the front end. Thus, the front end of the basis oil passage 150 becomes a downstream end portion of the oil feed passage 102.

The eight discharge ports 104 are disposed so as to correspond to the eight cams 36 of the exhaust-side camshaft 34A. Thus, the eight discharge ports 104 can feed the discharged lubricant to the eight cams 36. In this embodiment, the eight discharge ports 104 are disposed at such positions as to overlap with the respective eight cams 36 in plan view (not illustrated).

As illustrated in FIG. 3, although specific description is omitted, eight discharge ports 104 are provided also on the right (intake valve 31B side) of the oil feed member 100, similarly to the configuration of the left (exhaust valve 31A side).

Figure 6:
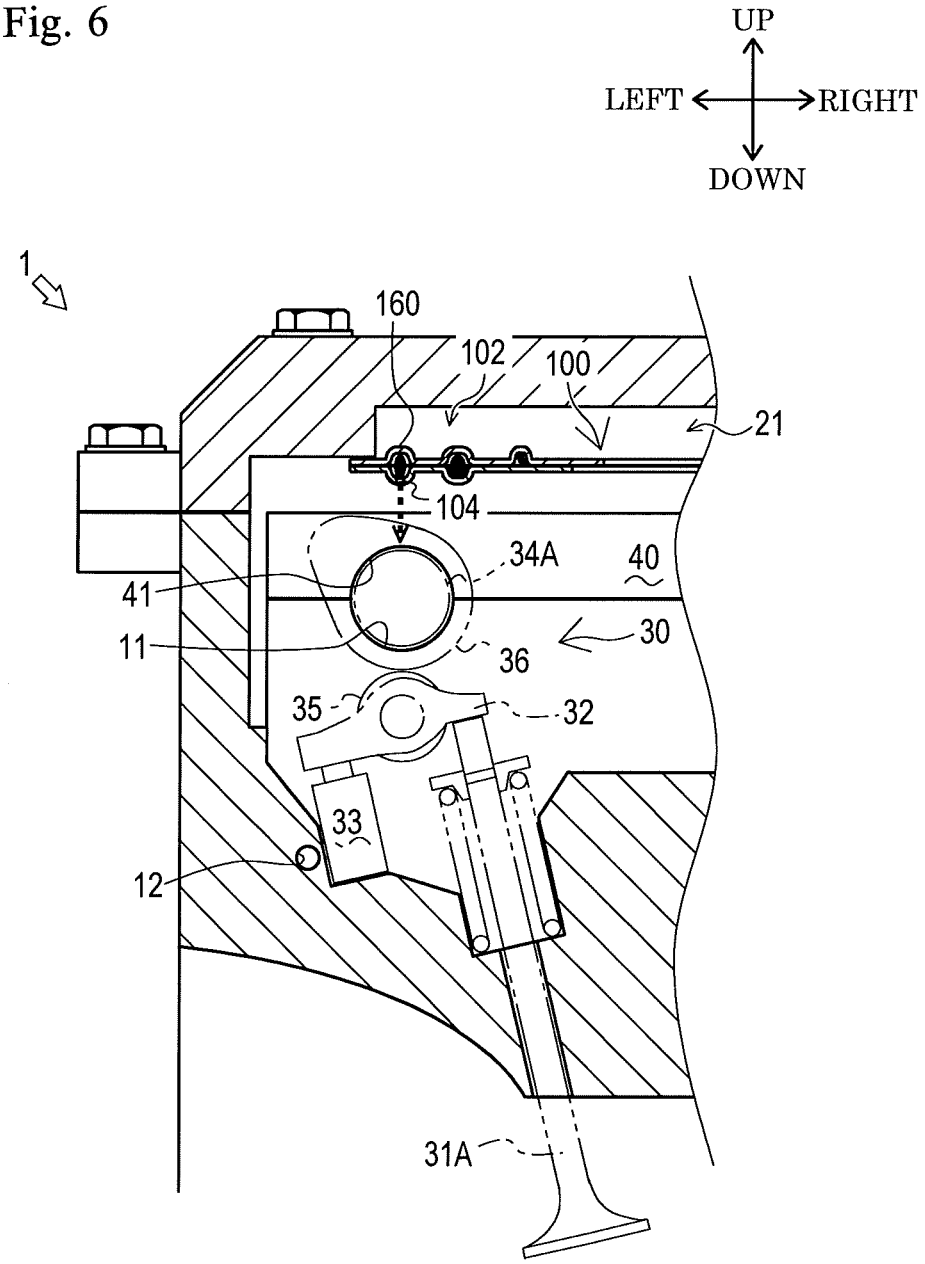
FIG. 6 is a diagram illustrating a state where lubricant is fed from the oil feed member to a lubrication portion.

In the oil feed passage 102 configured as described above, the lubricant from the oil feed port 103 is guided to the introduction oil passage 130, the distribution oil passage 140, the basis oil passage 150, the plurality of derived oil passages 160 (the first derived oil passage 161, the second derived oil passage 162, the third derived oil passage 163, the fourth derived oil passage 164, the fifth derived oil passage 165, the sixth derived oil passage 166, and the seventh derived oil passage 167) in order. Then, the lubricant fed to the left ends of the plurality of derived oil passages 160 and the front end of the basis oil passage 150 is discharged downward through the respective discharge ports 104. Thus, as illustrated in FIG. 6, the oil feed member 100 can feed the lubricant to the cams 36 of the exhaust-side camshaft 34A of the valve gear 30.

Hereinafter, configurations of the lengths of the plurality of derived oil passages 160 (circulation channels of lubricant) will be described in detail.

As described above, the second derived oil passage 162 is formed so as to be longer than the first derived oil passage 161. Additionally, the third derived oil passage 163 is formed so as to be longer than the second derived oil passage 162. Herein, the first derived oil passage 161, the second derived oil passage 162, and the third derived oil passage 163 are disposed from the back side to the front side toward a connection part of the basis oil passage 150 and the distribution oil passage 140 in order. Thus, the first derived oil passage 161, the second derived oil passage 162, and the third derived oil passage 163 are formed such that a derived oil passage disposed nearer a connection part of the distribution oil passage 140 and the basis oil passage 150 (eventually, the oil feed port 103) has a longer lubricant circulation channel.

As described above, the fourth derived oil passage 164 is formed so as to be longer than the fifth derived oil passage 165. Additionally, the fifth derived oil passage 165 is formed so as to be longer than the sixth derived oil passage 166.

Additionally, the sixth derived oil passage 166 is formed so as to be longer than the seventh derived oil passage 167. Herein, the seventh derived oil passage 167, the sixth derived oil passage 166, the fifth derived oil passage 165, and the fourth derived oil passage 164 are disposed from the front side to the back side toward the connection part of the basis oil passage 150 and the distribution oil passage 140 in order. Thus, the seventh derived oil passage 167, the sixth derived oil passage 166, the fifth derived oil passage 165, and the fourth derived oil passage 164 are formed such that a derived oil passage disposed nearer the oil feed port 103 has a longer lubricant circulation channel.

Also in a case where all the derived oil passages (the first derived oil passage 161, the second derived oil passage 162 and the third derived oil passage 163, and the fourth derived oil passage 164, the fifth derived oil passage 165, the sixth derived oil passage 166 and the seventh derived oil passage 167) are compared, the derived oil passages are formed such that a derived oil passage disposed nearer the connection part of the distribution oil passage 140 and the basis oil passage 150 (eventually, the oil feed port 103) has a longer lubricant circulation channel.

Herein, pressure loss is caused in lubricant circulated forward and backward from the connection part of the basis oil passage 150 and the distribution oil passage 140. That is, the pressure loss of lubricant increases as getting farther away from the connection part of the basis oil passage 150 with the distribution oil passage 140, and therefore it is considered that an amount of distributed lubricant of a derived oil passage disposed far from the connection part is less than an amount of distributed lubricant of a derived oil passage near the connection part.

However, in this embodiment, the first derived oil passage 161, the second derived oil passage 162, and the third derived oil passage 163 are formed such that the derived oil passage disposed nearer the oil feed port 103 has the longer lubricant circulation channel. Additionally, the seventh derived oil passage 167, the sixth derived oil passage 166, the fifth derived oil passage 165, and the fourth derived oil passage 164 are formed such that the derived oil passage nearer the oil feed port 103 has the longer lubricant circulation channel. Therefore, it is possible to reduce an influence on the basis oil passage 150 by pressure loss.

Specifically, for example, the long length (lubricant circulation channel) of the third derived oil passage 163 whose pressure loss of lubricant distributed from the basis oil passages 150 is small is secured, so that the pressure loss of lubricant circulated in the third derived oil passage 163 is increased. On the other hand, the length (lubricant circulation channel) of the first derived oil passage 161 whose pressure loss of lubricant distributed from the basis oil passages 150 is large is shortened, so that the pressure loss of lubricant circulated in the first derived oil passage 161 is reduced.

It is considered that the pressure loss of the discharge port 104 disposed farthest (in the eight discharge ports 104) from the connection part of the basis oil passages 150 with the distribution oil passage 140 is significantly large, and therefore the discharge port 104 disposed farthest is provided with no derived oil passage (discharge port 104 is directly provided in the basis oil passage 150).

With such a configuration, it is possible to equalize the amounts of lubricant discharged from the discharge ports 104 provided in the plurality of derived oil passages 160 (the first derived oil passage 161, the second derived oil passage 162, the third derived oil passage 163, the fourth derived oil passage 164, the fifth derived oil passage 165, the sixth derived oil passage 166, and the seventh derived oil passage 167), and the discharge port 104 provided in the front end of the basis oil passages 150.

Figure 7:
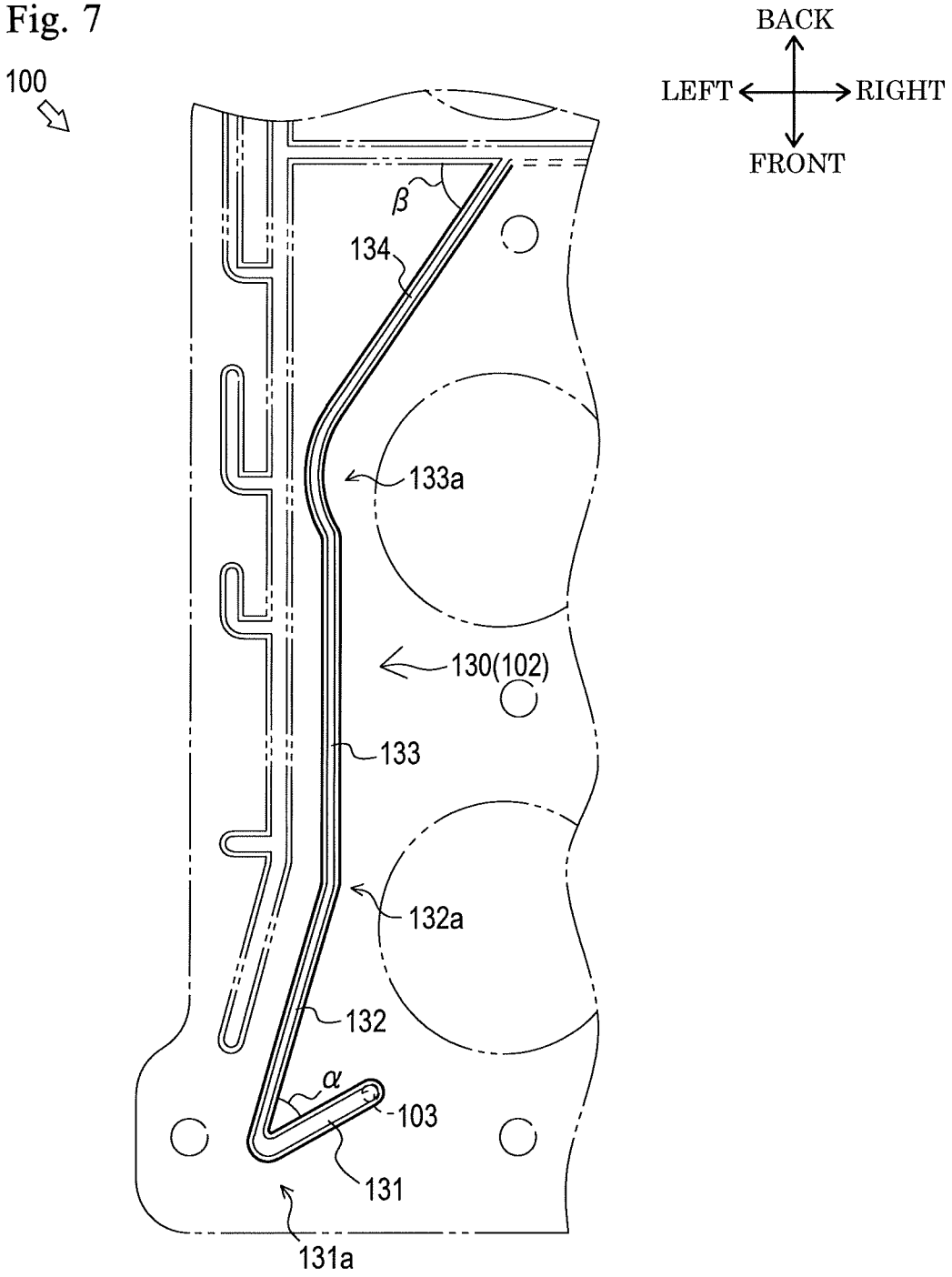
FIG. 7 is a plan view illustrating an introduction oil passage.

Hereinafter, a configuration of a shape of the introduction oil passage 130 will be described in detail with reference to FIG. 7.

The introduction oil passage 130 is disposed such that the longitudinal direction is generally directed to the front-back direction, and formed in a shape appropriately bent by a plurality of bent parts. The introduction oil passage 130 includes an introduction first oil passage 131, an introduction second oil passage 132, an introduction third oil passage 133, and an introduction fourth oil passage 134. Additionally, the plurality of bent parts include a first bent part 131*a*, a second bent part 132*a*, and a third bent part 133*a*.

The introduction first oil passage 131 linearly extends toward the left front side from the upstream end portion (a position overlapped with the oil feed port 103 in plan view) of the introduction oil passage 130. The first bent part 131*a* is disposed in the extending end of the introduction first oil passage 131. The extending direction of the introduction first oil passage 131 is changed (bent) from the left front side to the right back side at the first bent part 131*a*. The first bent part 131*a* is formed in a substantially V-shape in plan view. Herein, the pressure loss of the introduction oil passage 130 is adjusted by the bending angle (angle α illustrated in FIG. 7) of the first bent part 131*a*. In this embodiment, the bending angle of the first bent part 131*a* is set to be about 45 degrees.

The introduction second oil passage 132 linearly extends toward the right back side from the first bent part 131*a*. The second bent part 132*a* is disposed in the extending end of the introduction second oil passage 132. The extending direction of the introduction second oil passage 132 is changed (bent) from the right back side to the right behind at the second bent part 132*a*.

The introduction third oil passage 133 linearly extends toward the right behind from the second bent part 132*a*. The third bent part 133*a* is disposed in the extending end of the introduction third oil passage 133. The extending direction of the introduction third oil passage 133 is changed (bent) from the right behind to the right back side at the third bent part 133*a*. The third bent part 133*a* is formed in a substantially arcuate shape in plan view.

The introduction fourth oil passage 134 linearly extends toward the right back side from the third bent part 133*a*. The extending end of the introduction fourth oil passage 134 is connected to the distribution oil passage 140. Thus, the introduction fourth oil passage 134 is connected to the distribution oil passage 140 so as to form an angle (about 60 degrees in this embodiment) inclined to the longitudinal direction (the right-left direction) of the distribution oil passage 140 (refer to the angle β illustrated in FIG. 7).

Thus, the introduction oil passage 130 includes the plurality of bent parts (the first bent part 131*a*, the second bent part 132*a*, and the third bent part 133*a*), and the extending direction is appropriately changed, and therefore it is possible to increase the length of the introduction oil passage 130. Accordingly, it is possible to increase the pressure loss of lubricant in the introduction oil passage 130.

In the introduction oil passage 130, the plurality of bent parts (the first bent part 131*a*, the second bent part 132*a*, and the third bent part 133*a*) can give pressure loss to lubricant, and adjust the pressure loss of the lubricant in the introduction oil passage 130. The first bent part 131*a* in the plurality of bent parts is set such that the bending angle is an acute angle. Consequently, it is possible to further increase the pressure loss of the lubricant in the introduction oil passage 130 (compared to a case where there is no bent part set such that a bending angle is an acute angle).

Thus, in the introduction oil passage 130, it is possible to adjust the pressure loss of the lubricant while increasing the pressure loss, and it is possible to prevent the amount of lubricant circulated in the oil feed passage 102 of the oil feed member 100 from becoming excessive. That is, the amount of the lubricant circulated in the oil feed passage 102 of the oil feed member 100 can be made to be a suitable amount. Therefore, even in a case where lubricant from the oil gallery 12 is continuously (not intermittently) fed to the oil feed member 100, the lubricant can be prevented from being excessively fed from the oil feed member 100 to the cams 36 of the exhaust-side camshaft 34A.

As described above, the flow area of the introduction oil passage 130 is formed to be smaller than the flow area of the basis oil passage 150. That is, while it is possible to suppress the amount of the lubricant circulated in the introduction oil passage 130 while securing a sufficient amount of lubricant in the basis oil passage 150 connected to the plurality of derived oil passages 160 (in which the discharge ports 104 are disposed). Therefore, even in a case where the lubricant from the oil gallery 12 is continuously (not intermittently) fed to the oil feed member 100, the lubricant can be prevented from being excessively fed from the oil feed member 100 to the cams 36 of the exhaust-side camshaft 34A.

As described above, the oil feed member 100 according to the embodiment of the present invention is the oil feed member for feeding lubricant to the lubrication portions of the valve gears 30 for opening and closing the intake valves 31B and the exhaust valves 31A of the engine 1, which includes: the upper panel member 110 and the lower panel member 120 (pair of panel members) laid over each other; and the oil feed passage 102 (oil passage) formed by recessing laid surfaces of the upper panel member 110 and the lower panel member 120 (pair of panel members), wherein the oil feed passage 102 (oil passage) includes the basis oil passages 150 (downstream oil passage) formed on the downstream side, and the introduction oil passage 130 (upstream oil passage) formed on the upstream side and having a smaller lubricant flow area than that of the basis oil passages 150 (downstream oil passage).

With such a configuration, the lubricant can be prevented from being excessively fed from the oil feed member 100 to the lubrication portions (the cams 36 of the intake-side camshaft 34B and the cams 36 of the exhaust-side camshaft 34A) of the valve gears 30.

In the oil feed member 100, the introduction oil passage 130 (upstream oil passage) includes the first bent part 131*a*, the second bent part 132*a*, and the third bent part 133*a* that are bent to give pressure loss to the lubricant.

With such a configuration, the lubricant can be prevented from being excessively fed from the oil feed member 100 to the lubrication portions (the cams 36 of the intake-side camshaft 34B and the cams 36 of the exhaust-side camshaft 34A) of the valve gears 30.

In the oil feed member 100, the bent part includes the acute angle bent part (first bent part 131*a*) that is bent at an acute angle.

With such a configuration, the lubricant can be prevented from being excessively fed from the oil feed member 100 to the lubrication portions (the cams 36 of the intake-side camshaft 34B and the cams 36 of the exhaust-side camshaft 34A) of the valve gears 30.

The oil feed member 100 further includes: the oil feed port 103 formed in an upstream end portion of the oil feed passage 102 (oil passage), for receiving the lubricant to be fed to the oil feed passage 102; the plurality of discharge ports 104 for discharging the lubricant to the lubrication portions from above, the plurality of discharge ports 104 being formed in downstream end portions of the oil feed passage 102 (oil passage); the plurality of derived oil passages 160 (the first derived oil passage 161, the second derived oil passage 162, the third derived oil passage 163, the fourth derived oil passage 164, the fifth derived oil passage 165, the sixth derived oil passage 166, and the seventh derived oil passage 167) for guiding, to the respective plurality of discharge ports 104, the lubricant from the basis oil passages 150 (downstream oil passage), the plurality of derived oil passages 160 being branched from the basis oil passages 150 (downstream oil passage), wherein the plurality of derived oil passages 160 are formed such that a derived oil passage having a shorter lubricant circulation channel from the oil feed port 103 to a derived part (connection part of the derived oil passage 160 and the basis oil passage 150) has a longer lubricant circulation channel in the derived oil passage.

With such a configuration, it is possible to equalize the amounts of the lubricant discharged from the plurality of discharge ports 104.

In the oil feed member 100, the plurality of derived oil passages 160 have a smaller lubricant flow area than that of the basis oil passages 150 (downstream oil passage).

With such a configuration, the lubricant can be prevented from being excessively fed from the oil feed member 100 to the lubrication portions (the cams 36 of the intake-side camshaft 34B and the cams 36 of the exhaust-side camshaft 34A) of the valve gears 30.

The oil feed member 100 is mounted on the cylinder head cover 20 of the cylinder head 10 of the engine 1, and doubles as a baffle plate for partitioning the oil separator chamber 21 for separating oil from blow-by gas.

With such a configuration, it is possible to reduce the number of components.

In the oil feed member 100, the basis oil passage 150 (downstream oil passage), the plurality of derived oil passages 160, and the plurality of discharge ports 104 are provided on each of the intake valve 31B side and the exhaust valve 31A side.

With such a configuration, the single member (the oil feed member 100) can feed the lubricant to the lubrication portions on the intake valve 31B side and the exhaust valve 31A side (the cams 36 of the intake-side camshaft 34B and the cams 36 of the exhaust-side camshaft 34A), and it is possible to reduce the number of components.

In the oil feed member 100, the oil feed passage 102 (oil passage) includes distribution oil passages 140 for distributing and guiding, to the respective basis oil passages 150 (downstream oil passages) on each of the intake valve 31B side and the exhaust valve 31A side, the lubricant from the introduction oil passage 130 (upstream oil passage).

With such a configuration, the distribution oil passage 140 enables the lubricant from the single oil passage (introduction oil passage 130) to be distributed and guided to the respective basis oil passages 150 on the intake valve 31B side and the exhaust valve 31A side, and therefore it is possible to feed the lubricant to the lubrication portions on the intake valve 31B side and the exhaust valve 31A side (the cams 36 of the intake-side camshaft 34B and the cams 36 of the exhaust-side camshaft 34A).

Additionally, the lubricant feed mechanism for the engine 1 according to the present invention includes the oil feed member 100.

With such a configuration, the lubricant can be prevented from being excessively fed from the oil feed member 100 to the lubrication portions (the cams 36 of the intake-side camshaft 34B and the cams 36 of the exhaust-side camshaft 34A) of the valve gears 30.

The engine 1 according to this embodiment is an inline 4-cylinder double overhead camshaft (DOHC) 16-valve gasoline engine, but an engine to which the present invention can be applied is not limited to this.

The introduction oil passage 130 according to this embodiment is an embodiment of the "upstream oil passage" according to the present invention. The configuration (shape, for example) of the "upstream oil passage" according to the present invention is not limited to the configuration of the introduction oil passage 130.

The first bent part 131*a*, the second bent part 132*a*, and the third bent part 133*a* according to this embodiment each are an embodiment of the "bent part" according to the present invention. The configuration of the "bent part" according to the present invention is not limited to the configurations of the first bent part 131*a*, and the like. For example, the "bent parts" according to the present invention may not be three, and one, two, four or more bent parts may be provided.

The first bent part 131*a* according to this embodiment is an embodiment of the "acute angle bent part" according to the present invention. The configuration of the "acute angle bent part" according to the present invention is not limited to the configuration of the first bent part 131*a*. The "acute angle bent part" according to the present invention may not be one, but two or more "acute angle bent parts" may be provided.

Figure 9:
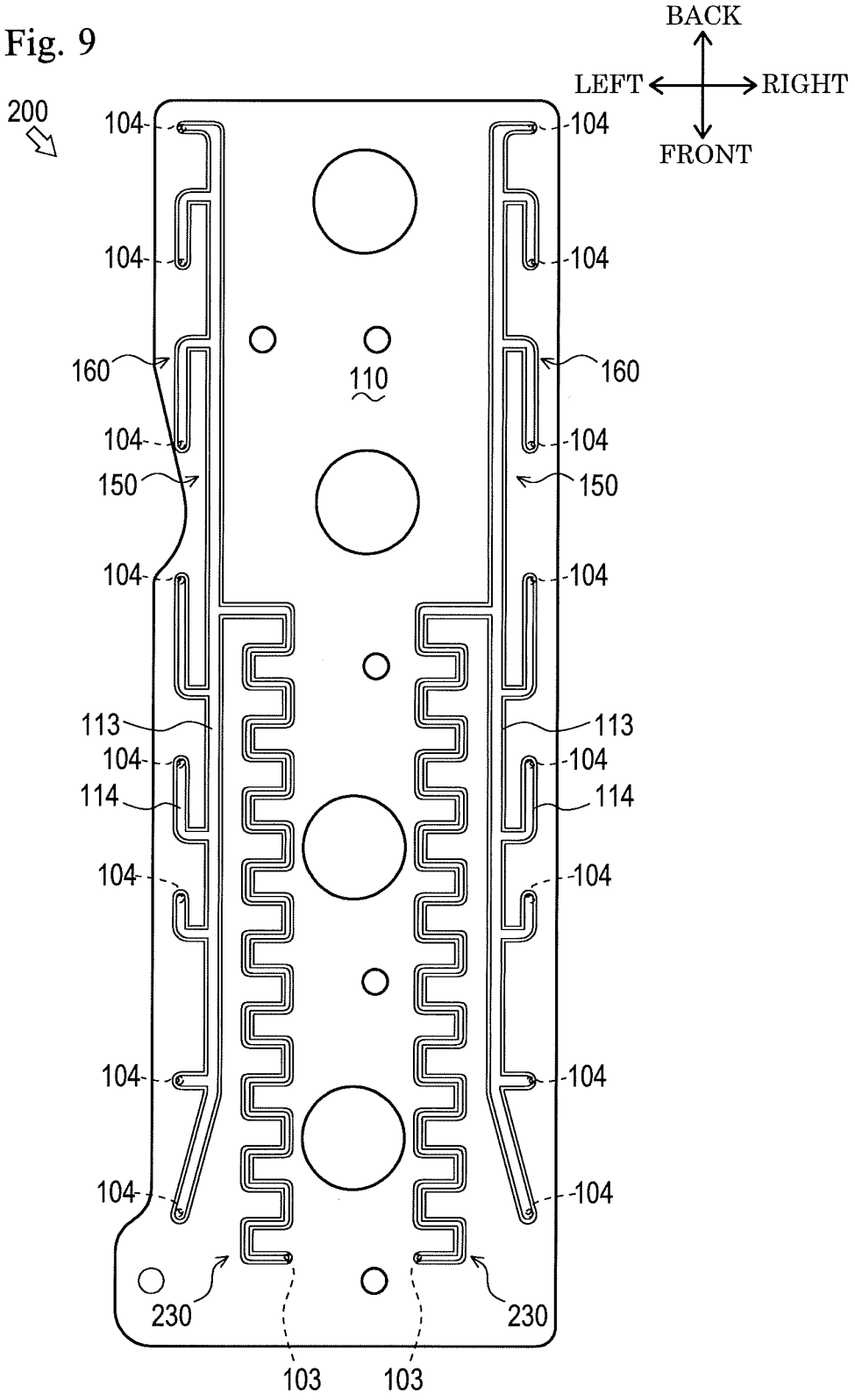
FIG. 9 is a plan view illustrating an oil feed member according to another embodiment.

FIG. 9 illustrates an oil feed member 200 according to another embodiment of the "oil feed member" according to the present invention.

In the oil feed member 200, introduction oil passages 230 are formed in zigzag by continuously disposing bent parts bent at a substantially right angle in plan view. With such a configuration, pressure loss can be applied to lubricant, and the pressure loss of the lubricant in each introduction oil passage 230 can be increased, and therefore the lubricant can be prevented from being excessively fed from an oil feed member 200 to cams 36 of an exhaust-side camshaft 34A.

In FIG. 9, no distribution oil passage is provided in the oil feed member 200, namely the respective introduction oil passages 230 are provided in left-side and right-side basis oil passages 150 (two introduction oil passages 230 are provided). However, a distribution oil passage can be provided, and one introduction oil passage 230 may be provided.

A material of the panel member (namely, the "pair of panel members" according to the present invention) for forming the "oil feed member" according to the present invention is not only metal, but can be also resin. Thus, in a case where resin is used as the material of the panel member for forming the "oil feed member" according to the present invention, it is possible to reduce the weight of the "oil feed member".

Thus, in the oil feed member 100, the upper panel member 110 and the lower panel member 120 (pair of panel members) are formed of resin.

With such a configuration, the oil feed member 100 enables reduction in weight.

INDUSTRIAL APPLICABILITY

The present invention is applicable to an oil feed member for feeding lubricant to lubrication portions of valve gears for opening and closing intake and exhaust valves of an engine, and a lubricant feed mechanism for an engine provided with the same.

REFERENCE SIGNS LIST

1: Engine
30: Valve gear
31A: Exhaust valve
31B: Intake valve
100: Oil feed member
102: Oil feed passage
110: Upper panel member
120: Lower panel member
130: Introduction oil passage
150: Basis oil passage

The invention claimed is:

1. An oil feed member for feeding lubricant to lubrication portions of valve gears for opening and closing intake and exhaust valves of an engine, the oil feed member comprising:

a pair of panel members laid over each other;

an oil passage formed by recessing laid surfaces of the pair of panel members, wherein the oil passage includes:

a downstream oil passage formed on a downstream side; and an upstream oil passage formed on an upstream side and having a smaller lubricant flow area than a lubricant flow area of the downstream oil passage;

an oil feed port formed in an upstream end portion of the oil passage, for receiving the lubricant to be fed to the oil passage;

a plurality of discharge ports for discharging the lubricant to the lubrication portions from above, the plurality of discharge ports being formed in downstream end portions of the oil passage; and a plurality of derived oil passages for guiding, to the respective plurality of discharge ports, the lubricant from the downstream oil passage, the plurality of derived oil passages being branched from the downstream oil passage, wherein the plurality of derived oil passages are formed such that a derived oil passage having a shorter lubricant circulation channel from the oil feed port to a derived part has a longer lubricant circulation channel in the derived oil passage.

2. The oil feed member according to claim 1, wherein the upstream oil passage includes a bent part that is bent to give pressure loss to the lubricant.

3. The oil feed member according to claim 2, wherein the bent part includes an acute angle bent part that is bent at an acute angle.

4. The oil feed member according to claim 2, wherein the plurality of derived oil passages have a smaller lubricant flow area than the lubricant flow area of the downstream oil passage.

5. The oil feed member according to claim 1, the oil feed member being mounted on a head cover of a cylinder head of the engine, and doubling as a baffle plate for partitioning an oil separator chamber for separating oil from blow-by gas.

6. The oil feed member according to claim 1, wherein the downstream oil passage, the plurality of derived oil passages, and the plurality of discharge ports are provided on each of the intake valve side and the exhaust valve side.

7. The oil feed member according to claim 3, wherein the plurality of derived oil passages have a smaller lubricant flow area than the lubricant flow area of the downstream oil passage.

8. The oil feed member according to claim 7, the oil feed member being mounted on a head cover of a cylinder head of the engine, and doubling as a baffle plate for partitioning an oil separator chamber for separating oil from blow-by gas.

9. The oil feed member according to any one of claim 8, wherein the downstream oil passage, the plurality of derived oil passages, and the plurality of discharge ports are provided on each of the intake valve side and the exhaust valve side.

10. The oil feed member according to claim 9, wherein the oil passage includes distribution oil passages for distributing and guiding, to the respective downstream oil passages on each of the intake valve side and the exhaust valve side, the lubricant from the upstream oil passage.

11. The oil feed member according to claim 10, wherein the pair of panel members are formed of resin.

12. A lubricant feed mechanism for an engine, comprising the oil feed member according to claim 11.

13. The oil feed member according to claim 2, the oil feed member being mounted on a head cover of a cylinder head of the engine, and doubling as a baffle plate for partitioning an oil separator chamber for separating oil from blow-by gas.

14. The oil feed member according to claim 7, wherein the downstream oil passage, the plurality of derived oil passages, and the plurality of discharge ports are provided on each of the intake valve side and the exhaust valve side.

15. The oil feed member according to claim 3, the oil feed member being mounted on a head cover of a cylinder head of the engine, and doubling as a baffle plate for partitioning an oil separator chamber for separating oil from blow-by gas.

16. The oil feed member according to claim 1, wherein the plurality of derived oil passages have a smaller lubricant flow area than the lubricant flow area of the downstream oil passage.

17. The oil feed member according to claim 1, wherein the pair of panel members are formed of resin.

18. A lubricant feed mechanism for an engine, comprising the oil feed member according to claim 1.

19. The oil feed member according to claim 6, wherein the oil passage includes distribution oil passages for distributing and guiding, to the respective downstream oil passages on each of the intake valve side and the exhaust valve side, the lubricant from the upstream oil passage.

* * * * *